US005383806A

United States Patent [19]

Prater

[11] Patent Number: 5,383,806

[45] Date of Patent: Jan. 24, 1995

[54] INFLATABLE BALLOONS WITH ANTI-BLOOMING AND ANTI-FOGGING COATINGS

[75] Inventor: Andy C. Prater, Willard, Ohio

[73] Assignee: Continental American Corporation, Wichita, Kans.

[21] Appl. No.: 40,107

[22] Filed: Mar. 30, 1993

[51] Int. Cl.[6] ..... A63H 3/06; A63H 37/00

[52] U.S. Cl. ..... 446/220; 446/186; 427/393.5; 427/430.1

[58] Field of Search ..... 446/220, 225, 226, 186, 446/187, 230, 385; 244/31, 126; 427/393.5, 430.1

[56] References Cited

U.S. PATENT DOCUMENTS 1,793,075 2/1931 Flowers .
1,801,666 4/1931 Geer .
1,858,460 5/1932 Ranseen .
2,061,522 11/1936 Shively .
2,295,708 9/1942 Bitter .
2,342,580 2/1944 Hartz .
2,373,529 4/1945 Beal .
2,391,986 1/1946 Leach .
2,523,312 9/1950 Leboime et al. .
2,646,370 7/1953 Nelson .
2,701,935 2/1955 Florence .
2,860,801 11/1958 Nielsen .
2,929,110 3/1960 Nickerson et al. .
3,108,396 10/1963 Dorman .
3,110,610 11/1963 Goodell .
3,140,969 1/1964 Sharenow .
3,149,011 3/1964 Ehrreich et al. .
3,182,932 5/1965 Winker .
3,184,742 5/1965 Cutler .
3,294,571 12/1966 Mayer .
3,415,767 12/1968 Kelly .
3,465,471 9/1969 Friedman .
3,475,201 10/1969 Hundt et al. .
3,519,530 7/1970 Struble, Jr. .
3,533,870 10/1970 Mackay et al. .
3,559,330 2/1971 Matlack .
3,561,579 2/1971 Allison .
3,591,975 7/1971 Tere .
3,608,903 9/1971 Cooper et al. .
3,609,949 10/1971 Neal .
3,611,623 10/1971 Copstead .
3,626,052 12/1971 Sisco et al. .
3,662,487 5/1972 Seefluth .
3,693,266 9/1972 Pressman .
3,727,229 4/1973 Clinger et al. .
3,766,108 10/1973 Liwa .
3,769,070 10/1973 Schilt .
3,805,442 4/1974 Matlack .
3,859,119 1/1975 Fletcher et al. .
3,870,298 3/1975 Varga .
3,914,478 10/1975 Johansson et al. ..... 427/393.5
3,933,723 1/1976 Grenness .
3,939,509 2/1976 Moore .
3,959,197 5/1976 Salyer et al. .
3,959,917 6/1976 Dawson .
3,972,526 8/1976 Cox, Jr. .
3,974,989 8/1976 Goodfellow ..... 244/126
3,999,751 12/1976 Scardino .
4,023,816 5/1977 Ellman et al. .
4,027,402 6/1977 Liu et al. .
4,033,137 7/1977 Geist .

(List continued on next page.)

OTHER PUBLICATIONS

PSC Polyurethane Specialties Co., Inc; "Realizing the Potential of Polyurethanes"/Millioxane Latex 280 Product Information.

*Primary Examiner*—Danton D. DeMille
*Attorney, Agent, or Firm*—Stinson, Mag & Fizzell

[57] ABSTRACT

A composition, method and apparatus for preserving the glossy, smooth exterior finish of a latex balloon wherein the exterior surface of the balloon is coated with an anionic aliphatic dispersion of polyester urethane material and dried. Coating can be accomplished by several methods including dipping in a bath. The coating can be applied either when the balloon is not inflated or inflated. The coating significantly increases the lifetime of the balloon without significantly decreasing buoyancy.

7 Claims, 2 Drawing Sheets

U.S. PATENT DOCUMENTS 4,035,149 7/1977 Scott et al. .
4,038,777 8/1977 Schwartz .
4,047,324 9/1977 Wesenberg .
4,077,588 3/1978 Hurst .
4,084,771 4/1978 Creuzet .
4,092,798 6/1978 Oquita .
4,094,299 6/1978 Voelker .
4,119,604 10/1978 Wysong .
4,120,259 10/1978 Wilson .
4,125,506 11/1978 Lundberg et al. .
4,143,109 3/1979 Stockum .
4,143,185 3/1979 Lundberg et al. .
4,145,838 3/1979 Mason .
4,149,338 4/1979 Wolf .
4,196,236 4/1980 Lundberg et al. .
4,208,469 6/1980 Dial .
4,232,477 11/1980 Lin .
4,243,220 1/1981 Shelley .
4,267,989 5/1981 Skaggs .
4,268,030 5/1981 Richards .
4,290,763 9/1981 Hurst .
4,292,999 10/1981 Szollmann .
4,305,501 12/1981 Collette .
4,307,537 12/1981 Bergmann .
4,336,662 6/1982 Baird .
4,361,625 11/1982 Beckmann et al. .
4,391,063 7/1983 Gill, III .
4,428,149 1/1984 Brown .
4,441,719 4/1984 Lohr .
4,470,218 9/1984 Yu .
4,486,975 12/1984 Harreld et al. .
4,534,525 8/1985 Bliamptis .
4,547,167 10/1985 Bergmann .
4,547,168 10/1985 Blacksberg et al. .
4,634,395 1/1987 Burchett .
4,925,893 5/1990 Padget et al. .
5,100,704 3/1992 Iwakura et al. ..... 427/393.5 X
5,110,629 5/1992 Gomberg et al. ..... 427/393.5 X
5,112,900 5/1992 Buddenhagen et al. .
5,141,463 8/1992 Rouse, Jr. .

INFLATABLE BALLOONS WITH ANTI-BLOOMING AND ANTI-FOGGING COATINGS

FIELD OF THE INVENTION

This invention relates to elastomeric balloons such as commonly used for toys or for ornamental arrangements. These balloons are filled with air or a gas that is lighter than air, such as helium.

BACKGROUND OF THE INVENTION

This invention deals with small "toy" balloons, as opposed to weather balloons or aeronautical balloons which carry a basket or gondola. These toy balloons are used for festive occasions, as children's toys, advertising media, special occasion bouquets with messages such as "Happy Birthday," "Happy Valentine's Day," etc. In recent years creative and artistic usages have included large-scale decorations and sculptures for banquets, dances, etc. The balloon manufacturer faces a number of problems with respect to the production of balloons. There are two types of balloons used for these purposes, latex and "Mylar" balloons. Mylar is a trademark of the DuPont Company, and such Mylar balloons are disclosed in U.S. Pat. No. 4,077,588. The use of Mylar in balloons has its own problems, and latex balloons remain the balloon of choice for many situations. Latex balloons are relatively easy and inexpensive to manufacture and can readily be imprinted with designs and lettering. However, latex balloons usually do not have a long life span in that, when produced, the exterior surface of the balloon has a shiny, glossy finish which is considered to be desirable. However, after the balloon is inflated, and particularly after being exposed to UV light and gases present in the air, the surface of the balloon tends to fog or bloom and becomes dull. This dulling of the surface layer is thought to result from oxidation or ozonation of the latex and results in an unattractive dulling of the surface finish and may lead to a long-term increase in the porosity of the latex membrane so that the balloon tends to more quickly lose its internal gas pressure and reach equilibrium with the ambient pressure. This dulling of the surface texture has been noticed to commence within a mere few hours after inflation and is readily apparent to any person, regardless of particular skill in the art, who has picked up his or her child's toy balloon after it is has been inflated for several days and noticed the dull and lusterless appearance.

Attempts have been made to increase the life span of the balloon by applying a protective coating to an inflated balloon through a spraying process. A recent patent directed to this subject but using a different process than that disclosed herein is U.S. Pat. No. 4,634,395 to Donald Burchett for INFLATABLE ELASTOMERIC BALLOONS HAVING INCREASED BUOYANT LIFETIMES. The Burchett Patent provides additional explanation and a history of elastomeric balloons.

SUMMARY OF THE INVENTION

The present invention involves a composition, a method and an apparatus for preserving the glossy, smooth exterior finish of a latex balloon. The latex balloon is coated with an anionic aliphatic dispersion of polyester urethane material and dried. Coating can be accomplished by several methods including dipping in a bath, spraying or the like and is preferably accomplished on an uninflated balloon in order to minimize the steps involved in the manufacturing process. This coating significantly enhances or increases the lifetime of the balloon without significantly decreasing the buoyancy of the balloon by adding significant weight. The coating preserves a smooth glossy finish and provides a long lasting attractively finished balloon. The process and coating may also increase the buoyant lifetime of the balloon by providing a barrier to gaseous diffusion through the latex membrane.

OBJECTS OF THE INVENTION

The objects of this invention are to provide a coating for increasing the lifetime of the favorable glossy and smooth exterior finish of a latex balloon; to provide such a coating which is easy and economical to apply; to provide such a coating which may be applied to the balloon when the balloon is in an uninflated condition in order to minimize additional manufacturing steps; to provide a coating which reduces or prevents fogging or blooming deterioration of the latex balloon exterior surface; and to provide a method and apparatus which is economical to manufacture and easy to use.

Other examples and objects of this invention will become apparent from the following description taken in connection with the drawings which describe the invention which may be embodied in various forms.

DESCRIPTION OF THE PREFERRED EMBODIMENT

As required by the statutes and case law, a detailed embodiment of the present invention is disclosed herein. It is to be understood, however, that the disclosed embodiment is merely exemplary of the invention, which may be embodied in many various forms. Therefore, the specific structural and functional details of the invention disclosed herein are not to be interpreted as limiting, but merely as a basis for the claims and as a representative basis for teaching one skilled in the art to variously employ the present invention in virtually any appropriately detailed structure.

Figure 1:
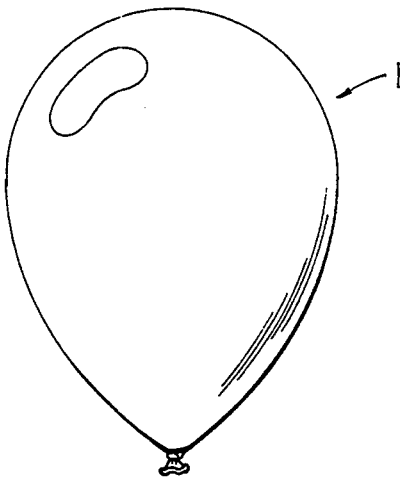
FIG. 1 is an elevational view of a balloon embodying the described and claimed process.

The reference number 1, FIG. 1, discloses a toy or decorative balloon. The balloon 1 has a smooth, glossy exterior finish. In the illustrated example, the balloon 1 has been coated in the process described following; however, the smooth, glossy exterior finish of the balloon 1 is of the same appearance whether the balloon has been coated, provided that the finish is viewed at the time of inflation of the balloon. After inflation, a latex balloon begins to fog, bloom or otherwise show a degradation in its smooth, attractive and glossy finish.

This degradation begins to occur shortly after inflation and is believed, in the inventor's opinion, to be due to oxidation or ozonation of the latex membrane. The following disclosed process substantially prevents or alleviates degradation of the smooth, glossy appearance of a new balloon by applying a particular coating. It is theorized that the coating prevents oxidation or ozonation and is therefore known as an anti-oxidant or anti-ozonate coating; however, it is not proven that the degradation is in fact due to oxidation or ozonation, and the inventor simply recognizes that the following disclosed coating and treatment prevent the degradation of the surface without fully appreciating or understanding the reasons for the surface degradation.

The balloon 1 is preferably of a natural latex, and the base balloon without the disclosed coating is made in accordance with practices well known to those familiar with the art of making latex balloons. The base balloon itself, therefore, is prior art.

Figure 2:
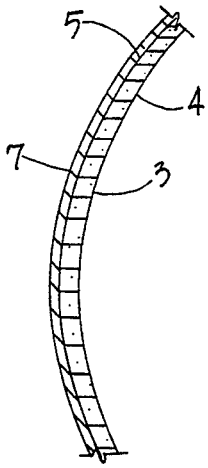
FIG. 2 is a fragmentary, cross sectional view of a portion of the membrane of the balloon shown in FIG. 1.
Figure 3:
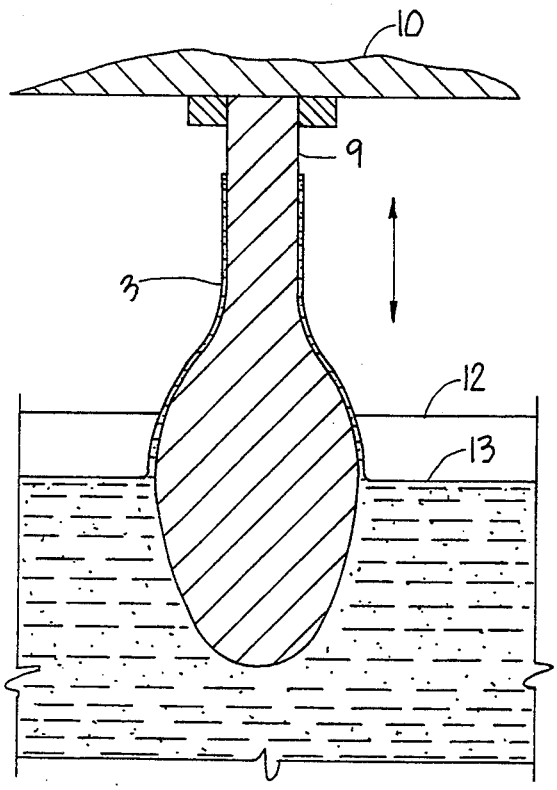
FIG. 3 is a fragmentary, sectional view showing a step in the manufacture of the disclosed balloon.
Figure 4:
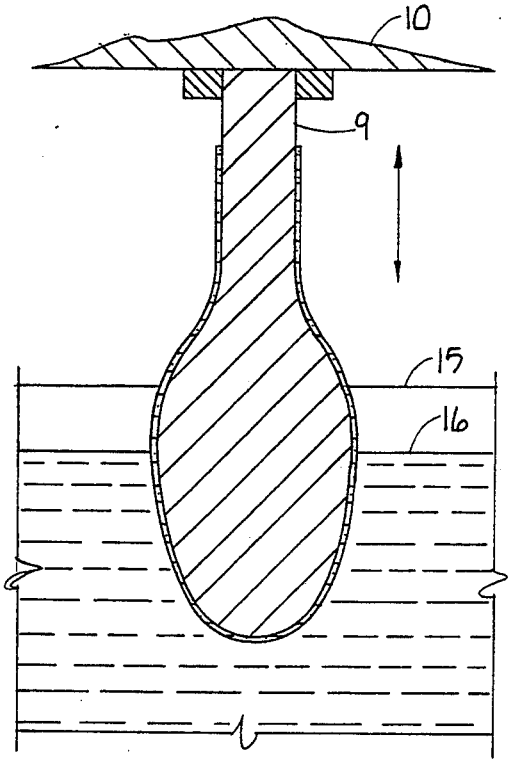
FIG. 4 is a fragmentary, sectional view showing a second step in the manufacture of the disclosed balloon.

FIG. 2, in sectional and fragmentary detail, illustrates a wall section of the balloon 1 including the latex membrane 3 of the balloon 1 with its inner and outer surfaces 4 and 5. The latex membrane 3 is a flexible, stretchable material having a modulus or elasticity such as is normal for such balloons, as is well known in the art. The wall section shown in FIG. 2 has an outer layer or coating 7, which in the illustrated example is applied to the outer surface 5 of the latex membrane 3, as it is the outer surface 5 which appears to evidence the most destructive fogging and blooming and which is in greatest need of protection. The coating 7 is an extremely thin layer, preferably less than 4 mil. in thickness, and which does not substantially add weight to the latex membrane 3 to degrade its buoyancy. In the illustration in FIG. 2, the coating 7 is shown for purposes of illustration only as being a relatively thick layer but in practice, the coating 7 is of insubstantial thickness.

The preferred coating material is an aqueous elastomeric material and is a polyester urethane in an anionic aliphatic dispersion in water. The dispersion has a solids content preferably in the range of 34%–42% with the optimum concentration being 38.25% plus or minus 0.75%, or generally 38%. Higher solids contents may be beneficially used; however, the inventor contends that when an aqueous solution having over approximately 42% solids content is applied, the buoyancy of the balloon begins to be adversely affected by the weight of the thicker coating layer. Below approximately 33%–34% of the solids content, the resulting coating layer is excessively thin, the viscosity is too low and use of this thin mixture may result in uncovered areas or portions of the balloon surface with a coating too thin to be effective.

The preferred polyester urethane compound utilized by the inventor is sold under the trade name of Milloxane Latex 280 and is a product of Polyurethane Specialties Company, Inc. of Lyndhurst, N.J. The Milloxane 280 compound is prepared as follows: to Milloxane 280 add sufficient deionized water to lower the solids content level to 38.25% plus or minus 0.075%. This generally requires adding 8 ounces of deionized water to each gallon of Milloxane 280. In addition to the adjusted solids level the addition of the deionized water is intended to provide a viscosity range of 65 to 90 CPS (Brookfield viscosimeter; No. 2 LVF spindle; speed of 30 RPM). Note that a solids level of 38.25% plus or minus 0.075% is considered optimum; however, satisfactory results have been obtained in the range of approximately 33%–34% to 42%.

The polyester urethane compound is also stretchable at a rate comparable to that of the latex membrane 3 to which the coating is applied. This prevents the balloon 1 from having a crinkled or puckered appearance. The polyester urethane compound also dries transparent so that the balloon color is not obscured. The compound also dries to provide a relatively hard surface which is not tacky and does not absorb dust, lint or leave a sticky film when touched.

Referring to FIGS. 3–6, there is common to all of these illustrations a representation of a balloon form internal mold 9 attached to a production line moving fixture 10. The mold 9, of course, is in the shape appropriate to the desired shape of the balloon when inflated.

As is usual in the art of making latex balloons, the mold 9 is first transported by conveyor machinery (not shown) to a liquid latex dip tank 12 wherein the mold 9 is inserted vertically downward into liquid latex 13. The mold 9 is withdrawn from the liquid latex 13 at a slow rate as is common in the industry.

In the next step of the process, the mold 9 is transported to a tank 15 containing leach water 16. At this state, the latex membrane 3 is in what is called the gel state, being solid but still substantially uncured or unvulcanized. The mold 9 with its uncured latex membrane 3 is at approximately 70° F. It is next immersed in the leach water 16. This is a timed hot water immersion intended to leach soluble materials from the dipped gel latex film. The temperature of the leach water is approximately 180° F.

Figure 5:
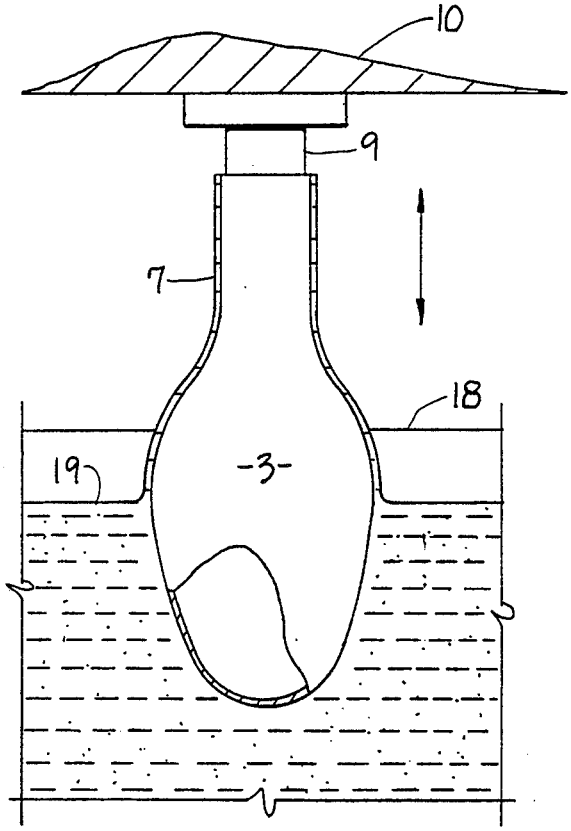
FIG. 5 is a fragmentary, sectional view showing a third step in the manufacture of the disclosed balloon.
Figure 6:
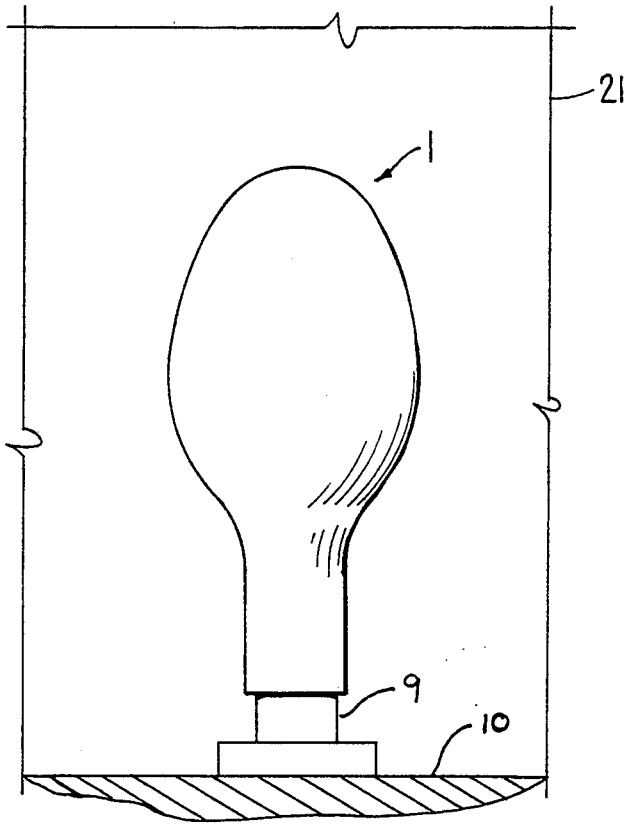
FIG. 6 is a fragmentary, sectional view showing a fourth step in the manufacture of the disclosed balloon.

Moving to the next step shown in FIG. 5, there is preferably an approximately three minute delay and then the mold 9 with its gel state latex membrane 3 is conveyed to a dip tank 18 containing the disclosed polyester urethane material 19. The material 19 should be constantly or at least periodically agitated so that the solids content does not begin to settle out. The mold 9 with its gel state latex membrane 3 is dipped vertically into the tank 18 with a dip out speed of also eight seconds per inch in order to form the outer layer or coating 7 on the latex membrane 3.

The polyester urethane material my be pigmented or transparent as desired.

Finally, the fixture 10 and mold 9 are inverted and conveyed to a hot air convection oven 21 wherein air of approximately 212° F. circulates around the mold 9 and vulcanizes the gel state latex film under the coating 7. The oven 21 is preferably a two-stage oven with a first section at approximately 200° F. with a timed dwell of the mold in that section of seven and one-half minutes, and then a second section at 220° F., also with a timed dwell of seven and one-half minutes.

The preferred embodiment described above utilizes a dipping process to apply the polyester urethane material to the latex membrane 3. However, it is believed that other processes, such as a spray process, might also provide satisfactory results. The important point is to apply the coating 7 of polyester urethane material to the latex membrane 3 in such a way that it does not peel or flake off of the latex membrane 3 and is permanently bonded thereto, although the particular form of bonding, whether by mechanical or chemical means, is not known.

Satisfactory results have been obtained in tests on balloons that have had to date an approximately seven-month period of inflation. In tested nine-inch balloons, in a six-month time period, there has been no noticeable fogging, blooming or oxidation. It is also believed that the above-described treatment may act to additionally seal off or prevent the latex membrane 3 from becoming porous and may help to prevent the loss or diminishment in air pressure, which causes the balloon to slowly decrease in size.

The present invention is directed both to a balloon with a polyester urethane additional layer and to the process for making such a balloon.

It is understood that while certain embodiments of the present invention have been illustrated and described, it is not to be limited to the specific forms or arrangements of parts herein shown, except as set forth in the following claims.

What is claimed and desired to be secured by Letters Patent is as follows:

1. A method of preserving a smooth, glossy finish of an inflatable, transparent, toy balloon originally having such finish, the balloon comprising a latex material having inside and outside surfaces, said method comprising the steps of:

a) holding the balloon upon a form;

b) applying to the balloon a solution comprising an aqueous anionic aliphatic dispersion of polyester urethane having a sufficient solids content to coat said balloon and create an outer layer; and c) drying said outer layer to provide a smooth, glossy finish without reduction in the transparency of said balloon.

2. The method set forth in claim 1 wherein the solids content is in the range of 34% to 42%.

3. A method of preserving a smooth, glossy finish of an inflatable transparent, toy balloon originally having such finish, the balloon comprising a latex material having inside and outside surfaces, said method comprising the steps of:

a) holding the balloon upon a form;

b) dipping the balloon in a bath comprising an aqueous anionic aliphatic dispersion of polyester urethane having a solids content in the range of 34% to 42%;

c) withdrawing said balloon from said bath to form an outer layer of said polyester urethane over at least a substantial portion of said balloon; and d) drying said outer layer to provide a smooth, glossy finish coat without reduction in the transparency of said balloon.

4. A toy balloon made by a process comprising the steps of:

a) providing an inflatable, transparent, toy balloon of latex material and having a smooth, glossy finish on the balloon exterior surface;

b) dipping said balloon in a bath comprising an anionic aliphatic dispersion of polyester urethane material which has a solids content in the range of 34% to 42%;

c) withdrawing said balloon from said bath to provide an overdip layer over said balloon exterior surface; and d) drying said overdip layer to provide a smooth, hard, glossy, protective finish over said balloon exterior surface which prevents fogging, blooming and oxidation of said balloon exterior surface and retains the original transparency of said balloon.

5. A toy balloon made by a process comprising the steps of:

a) providing a transparent, toy inflatable balloon of latex material and having a smooth, glossy finish on the balloon exterior surface; and b) applying an outer coating of an anionic aliphatic dispersion of polyester urethane material having a sufficient solids content to coat said balloon and create an outer layer over the exterior surface of said balloon, said polyester urethane material outer layer creating a smooth, hard, glossy protective finish over said latex material exterior surface to prevent fogging, blooming and oxidation of said latex material outer surface without reduction in the original transparency of said balloon.

6. A toy balloon comprising:

a) an inflatable transparent balloon of a stretchable latex membrane having an outer surface with a smooth, glossy exterior finish; and b) an exterior layer of an anionic aliphatic dispersion of polyester urethane material bonded over said balloon outer surface and having a sufficient solids content to form a smooth, hard, glossy, protective finish over said balloon exterior surface which prevents fogging, blooming and oxidation of said balloon exterior surface while retaining the original transparency of said balloon, said material being stretchable at substantially the same rate of stretching of said latex membrane so that said balloon may be inflated without crinkling.

7. The toy balloon set forth in claim 6 wherein said solids content is in the range of 34% to 42%.

* * * * *